United States Patent [19]

Sulko

[11] 4,290,735

[45] Sep. 22, 1981

[54] WATER PRESSURE BOOSTER SYSTEM

[75] Inventor: James C. Sulko, Tucker, Ga.

[73] Assignee: Syncroflo, Inc., Atlanta, Ga.

[21] Appl. No.: 46,772

[22] Filed: Jun. 8, 1979

[51] Int. Cl.[3] ..... F04B 49/02

[52] U.S. Cl. ..... 417/2; 417/12; 417/53; 417/6

[58] Field of Search ..... 417/269

[56] References Cited

U.S. PATENT DOCUMENTS

| | | | |
|---|---|---|---|
| 3,639,081 | 1/1972 | Gray | 417/12 |
| 3,746,471 | 7/1973 | Gray et al. | 417/12 |
| 4,179,242 | 12/1979 | Tateshita | 417/8 |
| 4,186,769 | 2/1980 | Boyce | 417/5 |

FOREIGN PATENT DOCUMENTS

| | | | |
|---|---|---|---|
| 2602685 | 7/1977 | Fed. Rep. of Germany | 417/2 |
| 73716 | 3/1916 | Switzerland | 417/3 |
| 515094 | 5/1976 | U.S.S.R. | 417/2 |

*Primary Examiner*—William L. Freeh

*Attorney, Agent, or Firm*—Newton, Hopkins & Ormsby

[57] ABSTRACT

A plurality of relatively large, high capacity, high head, pumps disposed in parallel in the basement of a building provide water under pressure throughout the water pipes in a high rise building. Pressurestatic switch means controls the operation of these main pumps. A small, low capacity, high head auxiliary pump of an auxiliary booster system in the upper regions of the building supplies water to an accumulator tank in the auxiliary system from the water pipes so that during periods of low demand, such as at night and on weekends, the operation of the main pumps will be minimized. A control assembly including a timer and pressurestatic limit switches in the auxiliary control system dictates when the auxiliary pump is actuated and shut off and when the accumulator tank is opened to the water pipes.

17 Claims, 2 Drawing Figures

11
30
52
54
51
50
53
72
73
74
75
86
71
76
48
83
SOL 1
77
70
65
66
67
45
46
47
60
61
62
63
64
44
43
42
68
PS4
PS3
PS2
P1
82
81
80
41
40
39
38
37
36
35
34
33
32
31
23
22
M
M1
9
12
13
19
18
17
P4
M3
M2
M4
10
16
15
P3
14
P2

WATER PRESSURE BOOSTER SYSTEM

BACKGROUND OF THE INVENTION

1. Field of the Invention

This invention relates to a water pressure booster system and is more particularly concerned with an apparatus and a process of boosting the water pressure in a high rise building.

2. Description of the Prior Art

In the past, numerous water pressure boosting systems have been devised. Such prior art water pressure boosting systems have included a plurality of pumps driven by electric motors, the pumps being arranged in parallel so as to pump the water from a water main into the riser in a high rise building, various branch pipes feeding the water to the various fixtures on respective floors in the building. A control system which includes a pressurestatic means, controls when one or several of the pumps are actuated and deactuated. These booster systems are normally designed to provide a minimum water pressure at the uppermost part of the building. They usually include relatively high horsepower motors which drive the pumps so that one or a plurality of the pumps is actuated when the water pressure drops below a predetermined pressure.

At nighttime and during periods of very low usage, the booster system of the prior art runs perhaps one of these large motors full time so as to maintain the pressure. This running of a single large motor waste energy, is expensive, generates noise and subjects the system to undue wear. If such a system were to be shut off, pressure would drop in the building and the upper floors would immediately loose water to their uppermost fixtures.

The device of the present invention is programmed by adjustable time clock means to allow the main pumping system or the main booster pumps to shut down during period of low flow conditions. Thus, at night and on weekends, the time clock of the present system is set so as to permit a relatively small motor and an accumulator tank in the upper reaches of the building to maintain the prescribed pressure on the system, without the necessity of actuating the main pumping system continuously.

SUMMARY OF THE INVENTION

Briefly described, the present invention includes, in the conventional water pressure booster system which has a plurality of relatively large motors respectively driving a plurality of pumps for maintaining the pressure in the water system of a high rise building, an auxiliary booster system cooperating therewith. The auxiliary booster system is connected in the upper area of the building to the riser and is programmed by an adjustable time clock to allow the main pumping system to be shut down during low flow conditions. These conditions are normally at night and on weekends and can be so set on the time clock.

During periods when the auxiliary system is allowed to operate by the timer, the system takes water from the building riser and boosts its pressure with a small low capacity high head auxiliary booster pump and feeds the water to an accumulator tank. The pressure in the accumulator tank is the same as the pressure to the pump. Therefore, the pump is able to put its full output into the accumulator tank. A minimum run time timer keeps the pump running until the maximum amount of water is stored in the accumulator tank. Once this minimum time has been allowed, the small auxiliary booster pump is shut off by the electrical control circuitry and a pressure regulating valve is opened so as to permit water to be fed from the accumulator tank to the water system.

The accumulator tank has air under pressure in its top portion and a diaphragm or bladder which separates the air under pressure from the water. Thus, the water stored under pressure is precharged by the accumulator tank and will be fed out through the pressure regulating valve and back into the building riser and to the various branch pipes in the building. The pressure regulating valve is set higher than the pressure normally developed by the main booster system at the point where the auxiliary system is connected. This allows all of the water from the accumulator tank to be fed back into the building riser, before the pressure starts to drop, to any appreciable extent. When the pressure drops back to a pressure slightly above the pressure set for the main booster pumps to be actuated, the small booster pump is again energized by the control system in order to again fill the accumulator tank. The operation of the small booster pump is repeated during preselected hours based on whatever flow rate is present at the time. The auxiliary booster system also includes two additional pressurestatic switches located on the inlet to the auxiliary booster pump. One pressure switch is the low pressure limit switch which shuts down the auxiliary booster system when the pressure in the riser or in the main water system is below a prescribed level. This protects the pump from destroying itself due to operation when there is no water available.

The other pressurestatic switch is a high pressure limit switch which protects the building piping should the pressure regulating valve on the auxiliary booster system malfunction and remain open and out of control. If a high pressure condition is sensed by this high pressure pressurestatic switch, the small booster pump will be shut off and the solenoid energized so as to close the pressure regulating valve and allow the main pump at the lower level to be restarted. Both of these protective pressurestatic switches have to be manually reset, once the cause has been corrected.

Associated with the auxiliary boosting system is an auxiliary panel which contains the electrical circuitry for controlling the auxiliary booster system and it is connected to a control panel in the basement or adjacent to the main pumps so that the auxiliary system may be manually cut on and off from the basement, when desired. The auxiliary booster system is operated with 110 volt a.c. current and therefore can be conveniently connected to any electrical outlet.

Accordingly, it is an object of the present invention to provide a water pressure boosting system to reduce to a minimum the energy required to keep the water pressure at a prescribed level.

Another object of the present invention is to provide a water pressure boosting system which is inexpensive to manufacture, durable in structure and efficient in operation.

Another object of the present invention is to provide a water pressure boosting system which will reduce the running of and therefore the wear on the main booster pumps of the water pressure boosting system.

Another object of the present invention is to provide a water pressure boosting system which is particularly useful during periods of low flow water conditions in the water piping of a high rise building.

Another object of the present invention is to provide a water pressure boosting system which will provide a substantially constant pressure throughout the system, particularly during periods of low flow conditions.

Another object of the present invention is to provide a water pressure boosting system which will operate automatically, shifting from the main water pressure boosting system to the auxiliary water pressure boosting system when low flow water conditions are anticipated.

Another object of the present invention is to provide a water pressure boosting system which will reduce the noise associated with such systems.

Another object of the present invention is to provide a water pressure boosting system which is readily adaptable to existing water pressure boosting systems and requires only a single connection to an existing water pressure boosting system and access to house current in order to adapt an existing system to a system of the present invention.

Another object of the present invention is to provide a water pressure boosting system which will reduce to a minimum the energy waste in existing water pressure boosting systems and reduce the amount of heat imparted to the water during the boosting operation.

Other objects, features and advantages of the present invention will become apparent from the following description when taken in conjunction with the accompanying drawings wherein like characters of reference designate corresponding parts throughout the several views.

DESCRIPTION OF THE PREFERRED EMBODIMENT

Figure 1:
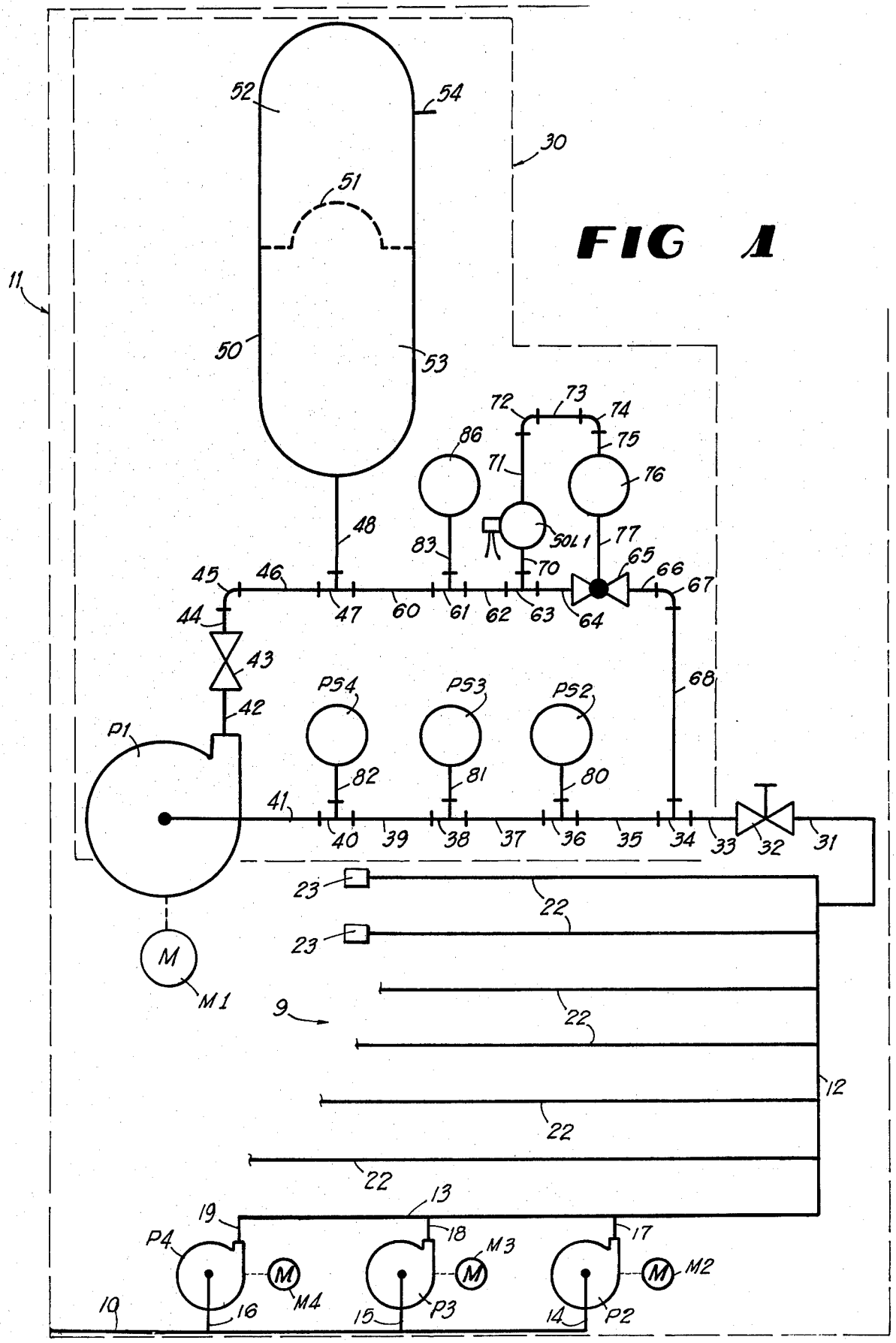
FIG. 1 is a schematic diagram of a water pressure boosting system in a building, the system being constructed in accordance with the present invention.

Referring now in detail to the embodiment chosen for the purpose of illustrating the present invention, numeral 10 in FIG. 1 denotes the water main or source of water under relatively low pressure which carries water to a water system 9 upwardly and/or outwardly in a high rise building, denoted generally by the numeral 11, the high rise building 11 being shown in broken lines. As is conventional, the water system 9 has a riser 12 which extends vertically throughout the building 11 and is a pipe which carries the water to the various floors. The lower portion of the water system 9, i.e. riser 12, in the basement of the building, is connected to and communicates with a water supply pipe 13. A plurality of high volume, high pressure, main booster pumps P2, P3 and P4 are disposed between the water main 10 and the water supply pipe 13, these pumps P2, P3 and P4 being arranged in parallel so as to take a suction, via pipes 14, 15 and 16, from the water main 10 and deliver the water, via pipes 17, 18 and 19, to the water supply pipe 13. Electric motors M2, M3 and M4 respectively drive the pumps P2, P3 and P4.

Figure 2:
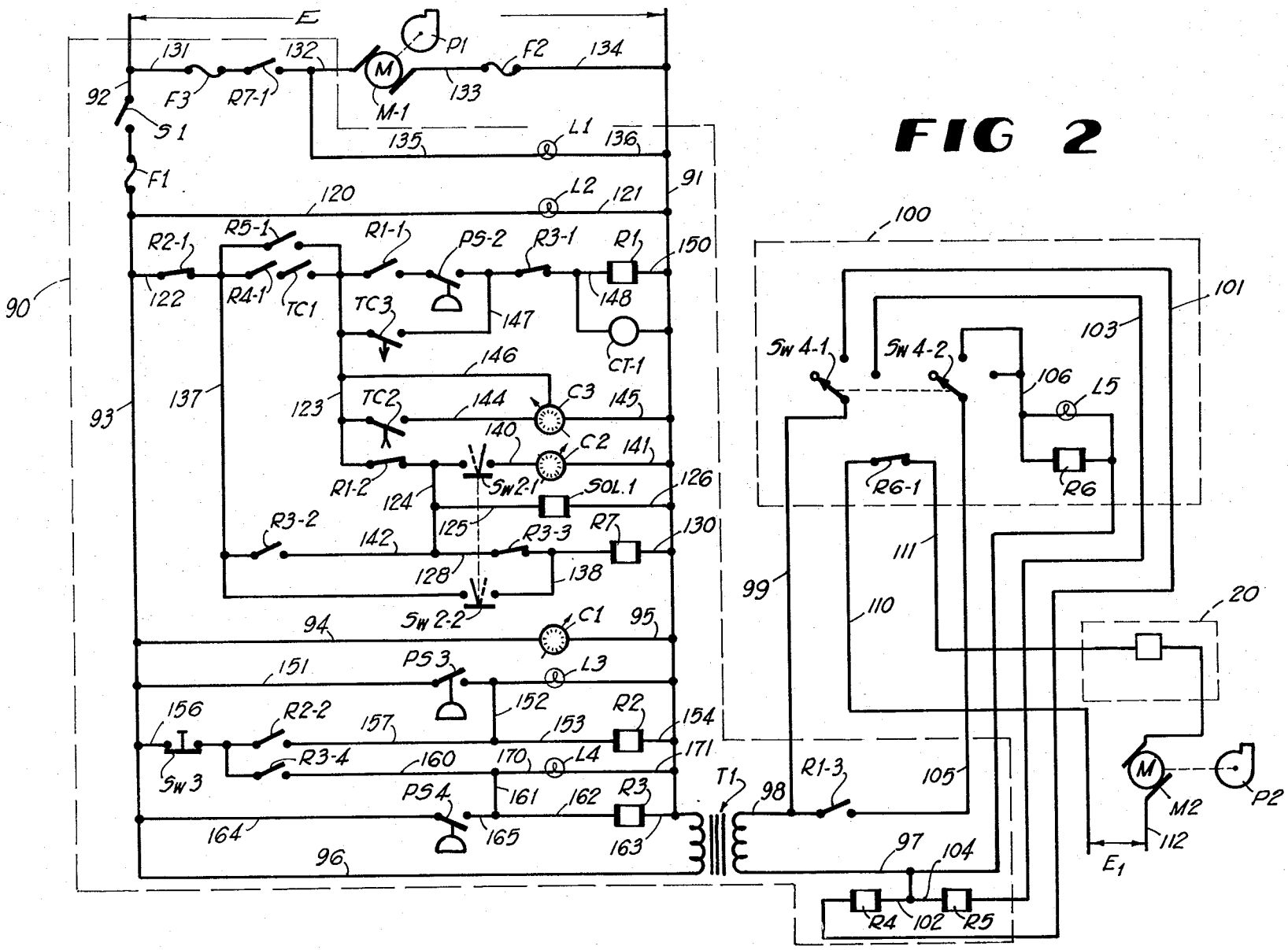
FIG. 2 is a wiring diagram of a portion of the electrical circuitry for the system of FIG. 1.

The energization and deenergization of motors M2, M3 and M4 is controlled via a main control panel, denoted generally by the numeral 20 in FIG. 2. Since this main control panel 20, the motors M2, M3 and M4 and the pump P2, P3 and P4 are conventional, no more detailed explanation of the operation of the control panel is deemed necessary. The control panel 20, however, includes pressurestatic means which will actuate selectively, the pump P2, P3 and P4. Usually the pump P2 will run continuously and then, if the demand is greater, pump P3 and, eventually, pump P4 will come on the line, during period of high flow conditions in the riser 12. Thus, for purpose of illustration I have indicated a control panel 20 within the water system 9 which includes the water supply pipe 13, the riser 12 and the branch pipes 22 which lead from the riser 12 to the various water facilities 23 on the respective floors of the building 11. In the water facility 23 are the usual wash basins, urinals, commodes, and the like (not shown).

Under usual operating conditions, the pump P2 is actuated by the motor M2 and at times pump P3 and P4 are actuated, in addition to pump P2. In the conventional water booster system, at night, only the pump P2 is in operation and this pump P2 is running continuously. Since there is little or no demand for water when the building is not occupied, except for such water as is required by the cleanup crews, this is a waste of energy and puts excessive wear on the pump P2.

As pointed out above, the motor M2 is a high-horse power motor and draws considerable current when the pump P2 is actuated. Since pump P3 and P4 are only actuated after pump P2 is actuated, it is rare indeed for the pumps P3 and P4 to be operated during low flow conditions, such as at night and on the weekends. Hence, the present invention is concerned with reducing, to a minimum, the running of pump P2 during low flow conditions.

According to the present invention, in the upper reaches of the building 11 is an auxiliary booster system denoted generally by the numeral 30 in FIG. 1. This auxiliary booster system 30 is connected, via pipe 31, to the water system 9, for example, at the upper floor in the building 11. Preferably the pipe 31 is connected to the riser 12; however, it will be understood by those skilled in the art that the pipe 31 may be connected at any place in the upper reaches of the water system, such as to the uppermost branch pipe 22. A manually operated main shut off valve 32 is provided on the end of the pipe 31 and, in turn, feeds to an auxiliary water supply pipe 33. Valve 32 normally remains open.

The supply pipe 33, when valve 32 is opened, supplies water to a T connection 34 and thence, via pipe 35 through T connections 36, pipe 37, T connections 38, pipe 39, T connection 40 and pipe 41 to the suction side of the auxiliary booster pump P1.

The discharge side of the auxiliary booster pump P1 feeds, via a pipe 42 and a non-return check valve 43, to a water transfer pipe 44 connected to one end of an elbow 45, the other end of which is connected, via pipe 46 to a T connection 47. T connection 47 connects, via pipe 48, to the bottom side of a hydraulic accumulator tank, denoted generally by the numeral 50. This accumulator tank 50 contains a flexible bladder or diaphragm 51 for separating the air 52 in the upper portion or top of the accumulator tank 50 from the water 53 in the lower portion of the accumulator tank 50. Air 52 is under a prescribed pressure slightly in excess of the pressure in the uppermost portion of water system 9, as will be explained, hereinafter. Air under pressure may be bleed from and fed to the top of the accumulator tank 50 via an air charge pipe 54, using conventional means. By controlling the pressure of the air 52, the pressure on water 53 can be regulated, as desired. The other port of T connection 47 is connected to a water transfer pipe 60 which is connected through T connection 61 and pipe 62 to T connection 63. The other port of T connection 61 is connected to a pressure gauge 86.

One port of T connection 63 is connected, via water supply pipe 64, to one side of a pressure regulating valve 65, the other side of which is connected, via pipe 66 and elbow 67, to a water discharge pipe 68. The water discharge pipe is connected to T connection 34.

The other port of T connection 63 is connected, via pipe 70 to a control valve of a solenoid valve SOL1. The other valve portion of solenoid valve SOL1 is connected via pipe 71 elbow 72, pipe 73, elbow 74 and pipe 75 to the pressurestatic control element 76 which controls, through connection 77, the opening and closing of the pressure regulating valve 65. When solenoid SOL1 is energized, Valve 65 is closed and when solenoid SOL1 is deenergized, valve 65 is allowed to open.

The T connection 36 is connected to a pressurestatic switch PS2, the T connection 38 is connected to a pressurestatic switch PS3 and the T connection 40 is connected to a pressure-static switch PS4 via pipes 80, 81 and 82, respectively.

Referring now to the wiring diagram of FIG. 2, the auxiliary panel, denoted generally by numeral 90, is physically disposed adjacent to the auxiliary booster system 30 and is connected to a conventional 110 volt a.c. source E via wires 91 and 92, the wire 91 being a neutral or ground bus or wire and the wire 92 being a hot wire or bus.

The wires 92 leads through a main on/off switch S1 and a fuse F1 to a hot bus 93 which is connected via wire 94 through clock C1 and wire 95 to the neutral bus or wire 91. Thus, when the switch S1 is closed, clock C1 is actuated and runs until the switch S1 is opened. Under usual conditions, the switch S1 is closed and remains closed.

Hot bus 93 also leads, via wire 96 to one side of the primary of a transformer T1, the other side of which is connected to the neutral bus 91. The transformer steps down the 110 volt a.c. current to 24 volts a.c. which is supplied from its secondary, via wires 97 and 98, down through the building to a secondary panel, denoted by the numeral 100. This secondary panel 100 is connected adjacent to the main panel 20.

Wire 98 supplies current via wire 99 to the sweep arm of a manually controlled selector switch, which includes switch Sw4-1 and Sw4-2 which are rotated manually and simultaneously from an off position as depicted in FIG. 2 to one of two prescribed positions. In the first position, i.e. the "automatic" position, the switch Sw4-1 contacts a terminal connected to wire 101 which is connected to one side of the relay coil R4 of a relay, the other side of which is connected, via wire 102, to wire 97 leading to the other side of the secondary of the transformer T1. Thus, in the first position of switch Sw4-1, the relay coil R4 is energized.

When the switch Sw1 is thrown to its second or manual position, a circuit is made from wire 99 through wire 103 to one side of a relay coil R5, the other side of which is connected via wire 104 to wire 97. In such a position, relay coil R5 closes switch R5-1 to bypass the time clock control system, to be described hereinafter. The booster pump P1 will thus be operated manually by switch S1, subject to the high and low pressure limit conditions dictated by the pressure-static switches PS3 and PS4 and minimum run clocks C2 and C3.

It will be understood that when switch Sw4-1 is in its automatic position, switch Sw4-2 is also in its automatic position and when switch Sw4-1 is in its manual position, switch Sw4-2 is also in its manual position. In either its automatic or first position or its manual or second position, the swing arm of switch Sw4-2 connects a wire 105 which leads from one side of a normally open relay switch R1-3 via the switch arm to a wire 106 which leads to one side of a lamp L5 and to one side of a relay coil R6. The lamp L5 and the relay coil R6 are arranged in parallel, the other sides of the lamp L5 and relay coil R6 being connected to the wire 97. Thus, in either the first or second position of switch Sw4-2, lamp L5 will be lighted and the relay coil R6 energized. The lamp L5 is disposed on the panel 100 to indicate that relay R1 in panel 90 is energized indicating that the accumulator is providing water to the building and that the current is available through Sw4-2 to relay coil R6. The supplying of current to the relay coil R6 opens the normally closed relay switch R6-1 in the secondary panel 100. Relay switch R6-1, opens and breaks the circuit to the motor M2 across the source of current $E_1$ in the basement by means of wires 110, 111 and 112. Thus, when the switches Sw4-1 and Sw4-2 are in either their first or second position, the motor M2 is under the control of the normally open relay switch R1-3 since the closing of relay switch R1-3 will energize relay coil R6 and open relay switch R6-1 to immobilize motor M2. When, however, the relay switch R1-3 is closed, the motor M2 will operate in its normal way so that the main pumps, including pump P2 and perhaps the pumps P3 and P4 will supply water to the water system 9 of the building 11.

Returning to the upper reaches of the building and to panel 90, it will be seen that the panel power lamp L2 is connected across the line from hot bus 93 to neutral wire 91 by wires 120 and 121 so that when switch S1 is closed, lamp L2 on the panel will be lighted to indicate that power has been supplied to the auxiliary panel 90 and that the time clock C1 is operating. The time clock C1 controls the opening and closing of the time clock switch TC1 which is normally open but is closed when the auxiliary booster system is to be operated. Switch TC1 is in series with relay switch R4-1 and is supplied with current from bus 93, via wire 122 and normally closed relay switch R2-1. In parallel with and across the two series arranged switches R4-1 and TC1 is a normally open relay switch R5-1. Thus, when the relay coil R4 is energized, the opening and closing of switch TC1 will supply current to a control wire 123. When, however, relay switch R5-1 is closed, the time clock C1, i.e. switch TC1 is bypassed and the wire 123 is rendered hot.

Connected to wire 123 through a normally closed relay R1-2 and wires 124 and 125 is one side of a regulating solenoid SOL1 to other side of which is connected via wire 126 to the neutral bus 91. Thus, when wire 123 is rendered hot, the regulating solenoid SOL1 is energized so as to render inoperative the pressure regulator 76 for opening and closing the valve 65 in response to the pressure of the water 53 in the accumulator tank 50.

Also connected to wire 124, via wire 128 and through normally closed relay R3-3, is a motor starter relay coil R7, the other side of which connected via wire 130 to the neutral bus 91. When the motor starter coil R7 is energized, it closes relay switch R7-1. Relay switch R7-1 is the main motor switch which is in series in a circuit with a fuse F3, the fuse being connected to a hot bus 92 via wire 131 and the switch R7-1 being connected to one side of motor M1 via wire 132, the other side of which is connected via wire 133, fuse F2 and wire 134 to the neutral bus 91. Across the motor M1 and fuse F2 is a motor running indicator lamp L1 which is connected via wire 135 to wire 132 and wire 136 to neutral bus 91. When pump motor M1 is running, it drives the auxiliary booster pump P1 and this is so indicated by the lighting of lamp L1. Lamp L1, L2, L3 and L4 are located on the face of panel 90.

Leading from the normally closed relay switch R2-1 is a wire 137 which leads to one of the terminals of a switch element Sw2-2 of a manual control switch, the other terminal of which is connected via wire 138 to the motor starter relay R7. The other switch element Sw2-1 of the manual control switch has one terminal which is connected to wire 124 and another terminal which is connected via wire 140 to the time clock C2, the other terminal of time clock C2 being connected by wire 141 to the neutral bus 91. When switch Sw2-1 is closed, switch Sw2-2 is opened and vise versa. The switch arm for switches Sw2-1 and Sw2-2 is on the face of the panel 90 so that it can be manually manipulated, as desired. When the switch arm is thrown so that switch Sw2-2 is closed, a circuit is made via wire 122, switch R2-1, wire 137, wire 138, and wire 130 to energize the motor starter relay coil R7 and close relay switch R7-1 to energize motor M1. When however, the switch arm is thrown so that switch SW2-1 is closed and switch Sw2-2 is opened, a circuit is made to the minimum run timer or clock C2 from wire 124.

One terminal of relay switch R3-2 is connected to wire 137 while the other terminal is connected via wire 142 to wire 124. Thus, relay switch R3-2, when closed, will supply current to the wire 124; however, it will be understood that relay switch R3-3 will at that time be opened.

Minimum run timer on clock C2 controls the normally open timer clock switch TC2, one terminal of the switch TC2 being connected to wire 123 and the other terminal being connected via wire 144 to one side of time clock C3, the other side of the time clock C3 being connected, via wire 145, to the neutral bus 91. Wire, 146, connected from wire 123 to the clock C3, is for operating the clock C3. When minimum run timer or clock C2 is energized, through Sw2-1, the normally open switch TC2 will close after a prescribed period of time (about 5 minutes). When switch TC2 closes it will energize time clock C3 through wires 123, 144 and 145. Time clock C3 will close switch Tc3 and allow current from wire 123 to wire 147 to go through switch R3-1 to wire 148 and energize relay coil R1. Relay coil R1, when energized opens switch R1-2 and deenergizes clock C2, which opens switch Tc2 which deenergized clock C3 and allows switch Tc3 to open after a prescribed period of time (about 10 seconds).

Across the relay coil R1 is a off time counter CT1 which counts the amount of time that the relay R1 is energized. Thus, indicating the time the pump P2 is off.

A normally open relay switch R1-1 is disposed in series with the pressurestatic switch PS2 between wire 123 and wire 147. Thus, when relay switch R1-1 and pressurestatic switch Ps-2 is closed, current is supplied from wire 123 through the relay switch R3-1 to energize relay coil R1.

The function of the relay of coil R1 is to render inoperative, the pumps P2 by closing switch R1-3 to energize coil R6 to open switch R6-1. Also, the closing of switch R1-1 by coil R1 forms a hold down circuit until a low pressure is detected in the line by switch PS2 which opens the circuit.

A wire 151 leads from the hot bus 93 through the pressurestatic switch PS3 and through wires 152 and 153 to one side of a relay coil R2, the other side of which is connected via wire 154 to the neutral bus 91. The pressurestatic switch PS3 is a low suction pressure alarm or limit switch which is closed when the pressure on the suction side of the auxiliary booster pump P1 drops below a prescribed pressure. When pressurestatic switch PS3 is closed, this energizes the relay coil R2, which in turn opens the relay switch R2-1 and closes a hold down circuit which includes the relay switch R2-2 which is in series with a normally closed, manual reset switch Sw3, the series arranged switches Sw3 and relay switch R2-2 being connected to hot bus 93 via wire 156 and to wires 152 and 153 via wire 157. Hence, once the relay R2-2 is energized through the closing of switch PS3, the hold down circuit of switch Sw3 and relay switch R2-2 will hold the coil R2 or energized until switch SW3 is opened after the fault has been corrected.

Also connected to the manual reset switch Sw3 is a relay switch R3-4 which is connected via wire 160, 161 and 162 to one side of relay coil R3, the other side of which is connected via wire 163 to the neutral bus 91. A wire 164 leading from the hot bus 93 connects to one terminal of the high pressure alarm or limit switch PS4, the other terminal of which is connected via wire 165 to the wires 161 and 162.

When pressurestatic switch PS4 is closed, as when there is an abnormally high pressure in the system, a circuit is made from the hot bus 93 through the relay coil R3 to the neutral bus 91, thereby momentarily energizing relay coil R3. This pulls in switch R3-4 to provide a hold down circuit through the manual reset switch Sw3 and thus relay R3 remains energized until the manual reset switch Sw3 is opened manually.

The energization of relay coil R3 closes relay switch R3-2 while opening relay switch R3-3. This causes the motor starter relay coil R7 to drop out, thereby rendering inoperative the motor M1. At the same time, however, since it is desired that the high pressure be obviated, the solenoid SOL1 will remain energized so that the accumulator tank 50 is not connected to the riser 12. Thus, the accumulator tank 50 is not capable of supplying water to the riser 12. A lamp L4 on the panel 90 is disposed across the relay coil R3 via wires 170 and 171 from wire 160 to the neutral bus 91 thus when the coil R3 is energized, lamp L4 is lighted to indicate that an abnormally high pressure exists in the system.

OPERATION

From the foregoing description, the operation of the present device should be apparent.

The auxiliary booster system is rendered operative by the closing of switch S1 on the auxiliary panel 90. When switch S1 is closed, control power is provided to the panel 90 through fuse F1. The control power light L2 is thus energized and power is also fed to the time clock C1 and to the alarm switches namely, the low pressure limit switch PS3 and the high pressure limit switch PS4 and the system pressure switch PS2. If the pressure is above a prescribed low pressure, pressurestatic switch PS3 will be open and if the pressure is below a prescribed high pressure, high pressure limit switch PS4 will also be opened.

Thus, during normal operations, the low suction or low limit pressurestatic switch PS3 will break the circuit to relay coil R2 and the coil will remain deenergized. This enables the relay coil R2-1 to remain closed.

The time clock C1, during the day, will open the contact or switch TC1, preventing the auxiliary system from operating during the daytime hours. At night, however, the time clock C1 will close switch TC1 and allow current to be supplied to the wire 123, provided the relay switch R4-1 is closed. Relay switch R4-1 will be closed in the event switches Sw4-1 and Sw4-2 in the basement are placed in the automatic position, i.e. in the first position of the switches. This will close a circuit from the secondary of the transformer T1 via wire 99 and wire 101 through relay R4 and wires 102 and 97.

With the energizing of wire 123, current will be supplied to the selector switch Sw2-1 which, when put in the automatic position, is closed, so as to allow power to go directly to the minimum run timer C2. Power is also fed through the relay switch R1-2 to energize the solenoid SOL1 so that it will cause the pressure regulating valve control 76 to hold the valve 65 in a closed condition. Furthermore, current is supplied via the normally closed relays R1-2, wires 124 and 128 and normally closed relay switch R3-3 to energize the motor starter relay R7. Relay R7 then pulls in the switch R7-1 which energizes motor M1 and lights the light L1.

Motor M1 then drives pump P1 which takes a suction from the building riser 12 through the open valve 32 and through the various pipes 35, 37, 39 and 41 and supplies this water up through pipe 42 and the non-return check valve 43 via the pipes 44, 46 and 48 into the accumulator tank 50. It will be remembered that since the solenoid SOL1 is energized, valve 65 remains closed. Thus, the accumulator tank 50 is filled with water.

The minimum run timer clock C2 closes the switch TC2 when clock C2 is energized by the closing of switch TC1. This completes the circuit via wire 144 to time clock C3 which then closes its normally open switch TC3 and energizes the relay R1 via a circuit including wire 147 and normally closed relay switch R3-1. The energizing of coil R1 causes relay switch R1-1 to close, and hence, in the event switch PS2 is closed, provides an alternate circuit bypassing the switch TC3. Thus, once switch TC3 has been closed, it can drop out and the relay R1 will remain energized until the system pressurestatic switch PS2 is opened.

The energizing of relay coil R1 opens relay switch R1-2 which deenergizes the solenoid SOL1, thereby permitting the pressure regulating element 76 to open the valve 65. Therefore, the water 53 in the accumulator is available to the riser 12 via pipes 66, 68, 33 and 31. The opening of relay switch R1-2 also interupts current to the relay coil R7 which opens switch R7-1 to shut off motor M1 and this, in turn, stops pump P1. The pressurestatic switch PS2 is set above the normal pressure in the riser 12 at the position of the auxiliary booster system 30. Usually the pressure in the riser 12 at this point is about 40 psi. This enables the system pressure switch or pressurestatic switch PS2 to remain closed until a drop in pressure is detected.

The energizing of relay coil R1 also closes contact R1-3 which, since the switch Sw4-2 is either in the automatic position or in the manual position, will supply current via wire 106 to energize relay R6 to open relay switch R6-1. The opening of relay switch R6-1 breaks the circuit to the motor M2 and hence the pump P2 can no longer supply water to the system. Thus, the system is wholly dependent upon the accumulator tank 50 for its supply of water. Light L5 is lighted thereby indicating the disabling of the motor M2 and the pump P2, as well as the pumps P3 and P4 which are cut in only after pump P2 is operating. Thus, the main booster pumps P2, P3 and P4 will remain off as long as the pressure can be maintained in the building riser 12. As the water is used up from the accumulator tank 50, the pressure in the system will slowly drop to slightly above the original system pressure. At this point, the system pressurestatic switch PS2 will open, thereby deenergizing relay coil R1 which, in turn, causes the switch R1-1 to open and the switch R1-2 to close which again energizes the solenoid SOL1, thereby causing the closing of the valve 65 and the energizing of the motor starter relay R7. Thus, the motor M1 is again energized to start pump P1 and the minimum run cycle is repeated. The deenergizing of relay R1 causes the opening of relay switch R1-3 which deenergizes relay coil R6, dropping out this relay and, thereby, closing relay switch R6-1 to start motor M2 and operate pump P2.

As pointed out above, if the pressure drops below a prescribed pressure, switch PS3 will be closed lighting light L3 to indicate a low suction condition and energizing relay coil R2 which opens its switch R2-1 which will deenergize relay coil R1, the solenoid SOL1, and the motor starter relay coil R7-1 thereby preventing operation of the motor M1. Relay coil R2 also closes switch R2-2 which produces a hold down circuit for the relay coil R2 until switch SW3 is manually opened. If abnormally high pressure is encountered in the system, the switch PS4 wwill be closed to energize relay R3. This in turn closes relay switch R3-4 to make a hold down circuit which holds the coil energized until switch SW3 is manually opened.

The auxiliary booster system is designed to provide moderate instantaneous flows.

It is now seen that only a very small motor M1 is required in order to operate pump P1. This materially reduces the cost of operation of the system during low flow conditions.

It will be obvious to those skilled in the art that many variations may be made in the embodiment here chosen for the purpose of illustrating the present invention without departing from the scope thereof as defined by the appended claims.

I claim:

1. In a water booster system for buildings of the type having a main booster system including main booster pump means having a suction side and a discharge side, said suction side being connected to a source of water, a piping system having fixtures on various floors within said building and connected to the discharge side of main booster pump means for receiving water pumped from said source by said main booster pump means, said piping system extending upwardly in said building from said main pump means for supplying water to all of said fixtures, and control means for controlling the actuation and deactuation of said main booster pump means, the combination therewith:

(a) an auxiliary booster pump at a level in said building above said main booster pump means and having a suction side connected to and on one of said various floors communicating with an upper portion of said piping system, said auxiliary pump means having a discharge side;

(b) an accumulator tank communicating with said discharge side of said auxiliary pump means for receiving water from the discharge side of said auxiliary pump means; and (c) means for releasing the water in said accumulator tank to said piping system.

2. The water booster system defined in claim 1 including means for deactuating said main booster pump means during periods in which said auxiliary booster pump is operative.

3. The water booster system defined in claim 1 including a check valve between the discharge side of said auxiliary booster pump and said accumulator tank to prevent the return of any appreciable water from said accumulator to the discharge side of said pump.

4. The water booster system defined in claim 1 including a timer for rendering operative and inoperative said auxiliary booster pump.

5. The auxiliary booster system defined in claim 1 including control means for controlling the actuation and deactuation of said auxiliary booster pump and said means for releasing the water in said accumulator to said piping system and second control means adjacent to said main pump means for selectively rendering operative and inoperative said main booster pump.

6. The water booster system defined in claim 1 including second control means for controlling the actuation and deactuation of said auxiliary booster pump, said second control means including a timer set to render operative said auxiliary booster pump during period in which the demand for water in said piping system is anticipated to be low.

7. In a water booster system for buildings of the type having a main booster system including main booster pump means having a suction side and a discharge side, said suction side being connected to a source of water, a piping system having fixtures on various floors within said buillding and connected to the discharge side of main booster pump means for receiving water pumped from said source by said main booster pump means, said piping system extending upwardly in said building from said main pump means for supplying water to all of said fixtures, and control means for controlling the actuation and deactuation of said main booster pump means, the combination therewith of:

(a) an auxiliary booster pump above said main booster pump means and having a suction side connected to and communicating with the upper portion of said piping system, said auxiliary pump means having a discharge side;

(b) an accumulator tank communicating with said discharge side of said auxiliary pump means for receiving water from the discharge side of said auxiliary pump means; and (c) means for releasing the water in said accumulator tank to said piping system;

(d) said means for releasing the water in said accumulator to said piping system including a solenoid regulator valve connected to said accumulator tank and pipe means connected between the suction side of said pump and said piping system.

8. The water booster system defined in claim 7 including control means for actuating said solenoid regulator valve and shutting down said auxiliary booster pump.

9. In a water booster system for buildings of the type having a main booster system including main booster pump means having a suction side and a discharge side, said suction side being connected to a source of water, a piping system having fixtures on various floors within said building and connected to the discharge side of main booster pump means for receiving water pumped from said source by said main booster pump means, said piping system extending upwardly in said building from said main pump means for supplying water to all of said fixtures, and control means for controlling the actuation and deactuation of said main booster pump means, the combination therewith of;

(a) an auxiliary booster pump above said main booster pump means and having a suction side connected to and communicating with the upper portion of said piping system, said auxiliary pump means having a discharge side;

(b) an accumulator tank communicating with said discharge side of said auxiliary pump means for receiving water from the discharge side of said auxiliary pump means;

(c) means for releasing the water in said accumulator tank to said piping system;

(d) a timer for rendering operative and inoperative said auxiliary booster pump; and a second time for regulating the time that said auxiliary booster pump is operative for filling said accumulator tank, said second timer being operative to actuate said means for releasing the water in said accumulator to said piping system when said auxiliary booster pump is shut off.

10. In a water booster system for buildings of the type having a main booster system including main booster pump means having a suction side and a discharge side, said suction side being connected to a source of water, a piping system having fixtures on various floors within said building and connected to the discharge side of main booster pump means for receiving water pumped from said source by said main booster pump means, said piping system extending upwardly in said building from said main pump means for supplying water to all of said fixtures, and control means for controlling the actuation and deactuation of said main booster pump means, the combination therewith of:

(a) an auxiliary booster pump above said main booster pump means and having a suction side connected to and communicating with the upper portion of said piping system, said auxiliary pump means having a discharge side;

(b) an accumulator tank communicating with said discharge side of said auxiliary pump means for receiving water from the discharge side of said auxiliary pump means;

(c) means for releasing the water in said accumulator tank to said piping system; and (d) control means operative when the pressure in said piping system drops below a prescribed pressure for rendering inoperative said auxiliary booster pump.

11. In a water booster system for buildings of the type having a main booster system including main booster pump means having a suction side and a discharge side, said suction side being connected to a source of water, a piping system having fixtures on various floors within said building and connected to the discharge side of main booster pump means for receiving water pumped from said source by said main booster pump means, said piping system extending upwardly in said building from said main pump means for supplying water to all of said fixtures, and control means for controlling the actuation and deactuation of said main booster pump means, the combination therewith of:

(a) an auxiliary booster pump above said main booster pump means and having a suction side connected to and communicating with the upper portion of said piping system, said auxiliary pump means having a discharge side;

(b) an accumulator tank communicating with said discharge side of said auxiliary pump means for receiving water from the discharge side of said auxiliary pump means;

(c) means for releasing the water in said accumulator tank to said piping system; and (d) control means for rendering inoperative said auxiliary booster pump when the pressure in said piping system is above a prescribed pressure.

12. Process of boosting the pressure of water in the water system of a building comprising:

(a) receiving water from a water main at the lower portion of said building;

(b) passing the received water upwardly into the water pipes disposed in said building above said lower portion;

(c) imparting from the lower portion of said building a force intermittently to said water for forcing the water into the upper portions of said piping system;

(d) disposing a pump and an accumulator tank in the upper portion of said building;

(e) pumping the water with said pump from the upper portion of said water system into said accumulator tank; and (f) thereafter releasing the water from said accumulator tank into the upper portion of said water system during a period in which said force is not applied to said water from said lower portion.

13. The process defined in claim 12 wherein the step of releasing the water from said accumulator tank into the the upper portion of said water system includes the step of detecting the pressure of said water in said water system and releasing the water from said accumulator tank into said system as pressure drops because of usage.

14. The process defined in claim 13 wherein the pressure of the water accumulated in said accumulator tank is controlled in said water pipes after said upper portion.

15. The process defined in claim 14 wherein said step of imparting a force intermittently to said water includes pumping said water from said main into said piping system via a pump which is cut on and off periodically, depending upon the pressure in said water system and wherein said pump is rendered inoperative during the period in which said accumulator is releasing water to said water system.

16. Process of boosting the pressure of water in the water system of a building comprising:

(a) receiving water from a water main at the lower portion of said building;

(b) passing the received water upwardly into the water pipes disposed in said building above said lower portion;

(c) Imparting from the lower portion of said building a force intermittently to said water for forcing the water into the upper portions of said piping system;

(d) disposing a pump and an accumulator tank in the upper portion of said building;

(e) pumping the water with said pump from the upper portion of said water system into said accumulator tank; and (f) thereafter releasing the water from said accumulator tank into the upper portion of said water system during a period in which said force is not applied to said water from said lower portion;

(g) the step of pumping the water from the upper portion of said water system into said accumulator tank being controlled by a time clock which renders operative said pump and said accumulator tank during periods of low demand for said water in said water system.

17. The process defined in claim 16 wherein the actuation of said pump is for a prescribed time, upon each actuation thereof.

* * * * *